US008061514B2

(12) United States Patent
Necchi

(10) Patent No.: US 8,061,514 B2
(45) Date of Patent: Nov. 22, 2011

(54) INTERCHANGEABLE CLOSING DEVICE FOR ANTI-THEFT CASE AND ANTI-THEFT CASE EQUIPPED WITH SUCH DEVICE

(76) Inventor: Pietro Necchi, Borgoratto (IT)

( * ) Notice: Subject to any disclaimer, the term of this patent is extended or adjusted under 35 U.S.C. 154(b) by 252 days.

(21) Appl. No.: 12/598,695

(22) PCT Filed: May 3, 2007

(86) PCT No.: PCT/IT2007/000326

§ 371 (c)(1),
(2), (4) Date: Nov. 3, 2009

(87) PCT Pub. No.: WO2008/136023

PCT Pub. Date: Nov. 13, 2008

(65) Prior Publication Data

US 2010/0122986 A1 May 20, 2010

(51) Int. Cl.
*E05B 65/00* (2006.01)
*B65D 85/57* (2006.01)

(52) U.S. Cl. ..... 206/308.2; 206/387.11; 206/1.5; 70/57.1; 70/63

(58) Field of Classification Search ..... 206/308.2, 206/387.11, 1.5, 308.1; 70/57.1, 63
See application file for complete search history.

(56) References Cited

U.S. PATENT DOCUMENTS

| | | | | |
|---|---|---|---|---|
| 7,257,971 | B2 * | 8/2007 | Lax et al. | 70/57.1 |
| 7,320,235 | B2 * | 1/2008 | Belden et al. | 70/57.1 |
| 2002/0046963 | A1 | 4/2002 | Belden, Jr. et al. | |
| 2003/0196917 | A1 * | 10/2003 | Broadhead | 206/308.2 |
| 2004/0173477 | A1 | 9/2004 | Lax et al. | |
| 2004/0200744 | A1 * | 10/2004 | Mitsuyama | 206/308.2 |
| 2005/0087109 | A1 | 4/2005 | Bruhwiler | |
| 2005/0279143 | A1 * | 12/2005 | Belden et al. | 70/57.1 |
| 2006/0102501 | A1 * | 5/2006 | Hu | 206/308.2 |

FOREIGN PATENT DOCUMENTS

| | | |
|---|---|---|
| EP | 1445406 | 8/2004 |
| NL | 1003965 | 6/1998 |
| WO | 2004033830 | 4/2004 |

OTHER PUBLICATIONS

International Search Report for PCT/IT2007/000326 mailed Feb. 29, 2008.

* cited by examiner

*Primary Examiner* — Jacob K Ackun
(74) *Attorney, Agent, or Firm* — Stephen Bongini; Fleit Gibbons Gutman Bongini & Bianco PL

(57) ABSTRACT

A closing device (1) for an anti-theft case (100) is described, equipped with a closing/opening system adapted to be actuated by a detaching device or uncoupling device, and further equipped with means for securing to such anti-theft case (100) so that the closing device (1) can be applied to or removed from the anti-theft case 100) only when this latter one is open. An anti-theft case (100) equipped with a closing device (1) is further described.

18 Claims, 4 Drawing Sheets

INTERCHANGEABLE CLOSING DEVICE FOR ANTI-THEFT CASE AND ANTI-THEFT CASE EQUIPPED WITH SUCH DEVICE

The present invention refers to an interchangeable closing device for anti-theft case, in particular for compact-discs, musicassettes, videocassettes, DVDs, books or the like; the present invention further refers to an anti-theft case, in particular for compact-discs, musicassettes, videocassettes, DVDs, books or the like equipped with such device.

Anti-theft cases are known in the art and are usually made of transparent polycarbonate, adapted to prevent the theft of compact-discs, musicassettes, videocassettes, DVDs, books or the like, placed inside them during their exposure for their sale. Such cases in fact are equipped with closing devices with closing/opening systems that allow opening the case itself and withdrawing the product package inside it only by using a suitable and dedicated detaching device, generally of the magnetic type, or an uncoupling device available for the service personnel. Such cases can further be protected with radio-frequency (RF), electromagnetic (EM) or acoustic-magnetic (AM) safety systems or adhesive labels, or their combinations, cooperating with anti-theft detecting barriers.

Such cases have the inconvenience that the anti-theft closing device is completely integrated in the case itself. Therefore, if it is desired to replace the anti-theft device, due for example to its breakage or malfunction, or to change the type of detecting system to be used or the type of uncoupling device and detaching device to be used for opening this, it would be necessary to replace also the case to which it is connected, with the consequent burden of an additional expense.

In parallel, in case of breaking or excessive wear of the anti-theft case that requires its replacement, it would be necessary to also replace the closing device integrated therewith.

Therefore, object of the present invention is solving the above prior art problems by providing an interchangeable closing device for anti-theft case that is equipped with securing means to the case itself in order to allow its easy removal without impairing its safety characteristics.

Another object of the present, invention is providing an interchangeable closing device for anti-theft case that can be equipped with any radio-frequency (RF), electromagnetic (EM) or acoustic-magnetic (AM) detecting system or adhesive label or their combinations.

Moreover, an object of the present invention is providing an interchangeable closing device for anti-theft case that can be characterised by a system of any known magnetic uncoupling device or detaching device.

A further object of the present invention is solving the above prior art problems by providing an anti-theft case equipped with a closing device that can be easily removed without impairing its safety characteristics.

The above and other objects and advantages of the invention, as will result from the following description, are obtained with an interchangeable closing device for anti-theft case as claimed in claim 1, and with an anti-theft case as claimed in the claims. Preferred embodiments and non-trivial variations of the present invention are the subject matter of the dependent claims.

The present invention will be better described by some preferred embodiments thereof, provided as a non-limiting example, with reference to the enclosed drawings, in which:

FIG. 1*a* shows a top perspective view of a preferred embodiment of the closing device according to the present invention;

FIG. 1*b* shows a bottom perspective view of the closing device of FIG. 1*a;*

Figure 1A:
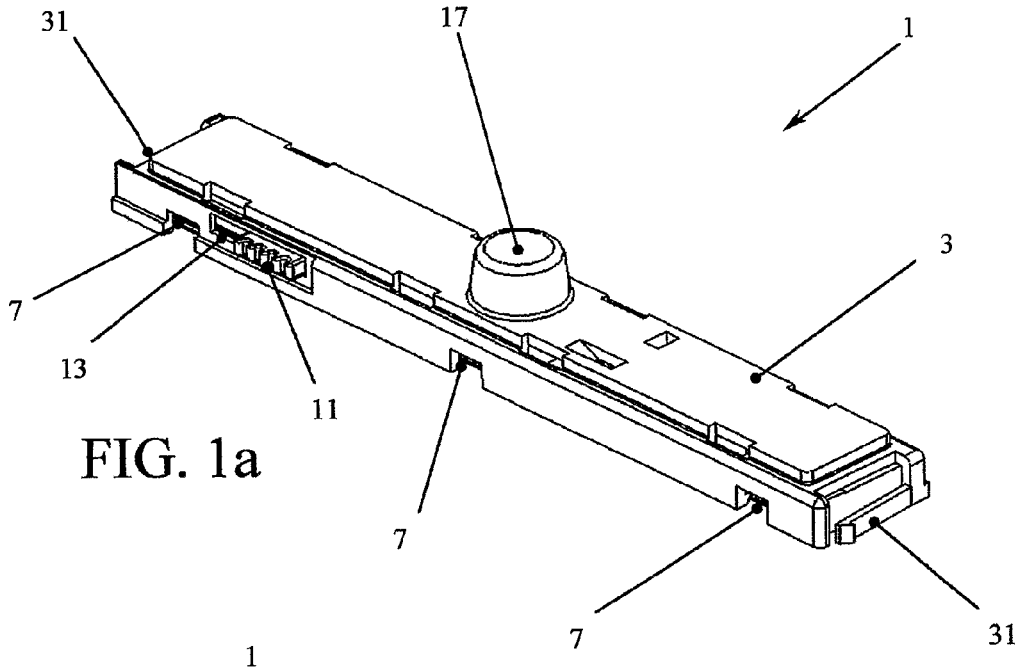
Figure 1B:
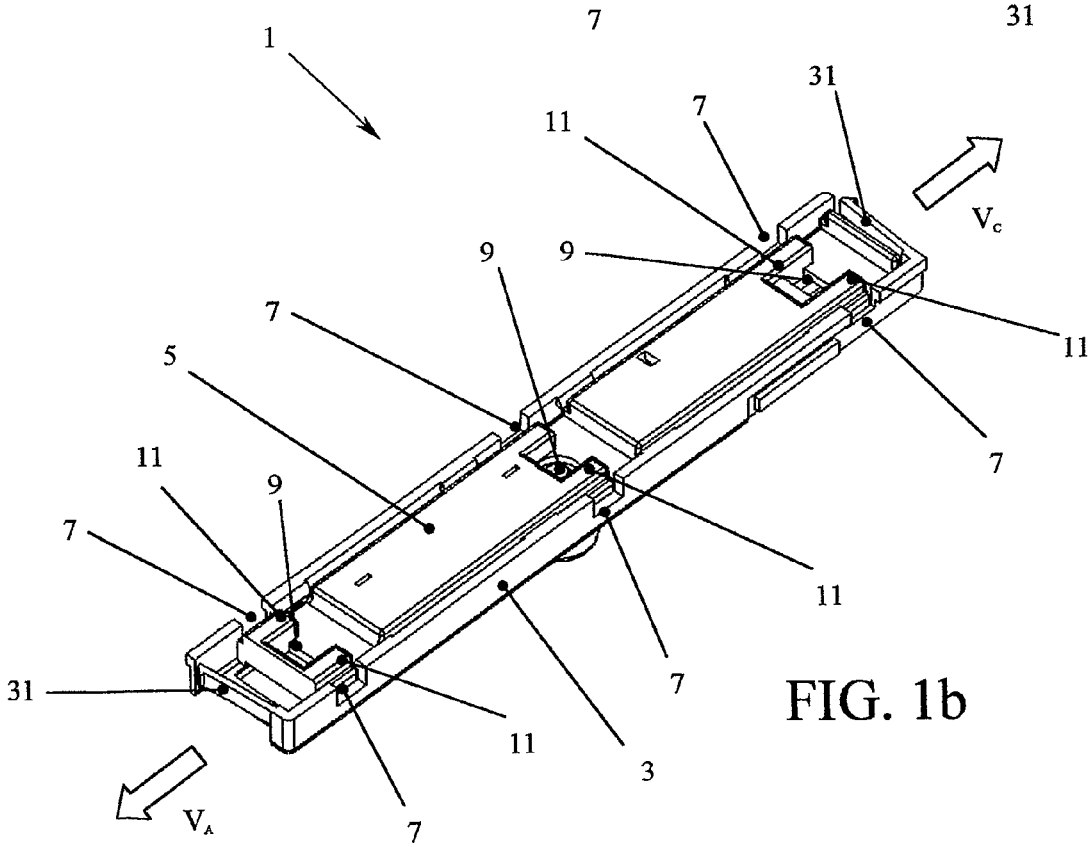

The interchangeable closing device 1 according to the present invention is adapted to be coupled in an easily removable way, but as can be seen below without impairing its intrinsic safety characteristics, to an anti-theft case 100, in particular aimed to protect against the theft of compact-discs, musicassettes, videocassettes, DVDs, books or the like, such anti-theft case 100 being preferably of the type composed of two half-shells, respectively 101*a*, 101*b*, mutually hinged along at least one side 103 in order to allow opening and inserting or removing the product to be protected inside the case. In particular, the closing device 1 according to the present invention, in addition to being equipped with one or more known safety systems or adhesive labels (as can be seen below in greater detail) and with a closing/opening system adapted to be actuated by a detaching device or uncoupling device of a known type (also in this case as will be seen below in greater detail), is equipped with means for securing it to the anti-theft case 100, such that the closing device 1 can be applied or removed to/from the anti-theft case 100 itself only when this latter one is open: it is therefore clear that, in particular, the closing device 1 can be removed from the anti-theft case 100 only after that its closing/opening system has been opened through the suitable detaching device or uncoupling device.

With particular reference to FIGS. 1*a* to 5, it is possible to note that the closing device 1 according to the present invention is composed of an external body 3 inside which a locking slider 5 longitudinally slides along a closing direction (shown in FIG. 1*b* by arrow $V_C$) and an opening direction (shown in FIG. 1*b* by arrow $V_A$) in order to go to a respective closing position and a respective opening position.

On the perimeter, the external body 3 is equipped with at least one perimeter slit 7 that allows accessing from outside to at least one locking recess 9 inside the body 3, such recess 9 being defined by at least one closing tooth 11 integral with the locking slider 5 and corresponding to a respective slit 7. In particular, when the locking slider 5 is in its closing position (like the one, for example, shown in FIG. 1*b*), the closing tooth 11 is placed between the locking recess 9 and the related slit 7. When instead the locking slider 5 is in its opening position, namely when the locking slider 5 has been pushed along the opening direction $V_A$ from its previous closing position, the closing tooth 11 frees a passage between the locking recess 9 and the related slit 7. In order to allow an operator to easily slide the locking slider 5 with respect to the external body 3 with a finger, the slider 5 can be equipped with at least one tongue 11, preferably knurled for a better adherence with the finger itself, that goes out of a related guiding slot 13 of the external body 3 having a suitable length to allow the slider 5 to slide between its opening position and its closing position.

The safety device 1 is obviously equipped with at least one closing/opening system; advantageously, the device 1 can be potentially equipped with any closing/opening system, and therefore with a related type of detaching device or uncoupling device dedicated thereto, of a known type. For such purpose, merely as an example, FIGS. 2 to 4 show some preferred embodiments of the closing device 1 according to the present invention equipped with different types of closing/opening systems.

In particular, the closing/opening system is adapted to prevent that, once taken to its closing position, the locking slider 5 can slide along the opening direction $V_A$ with respect to the external body 3 without an intervention of a respective detaching device or uncoupling device.

Figure 2:
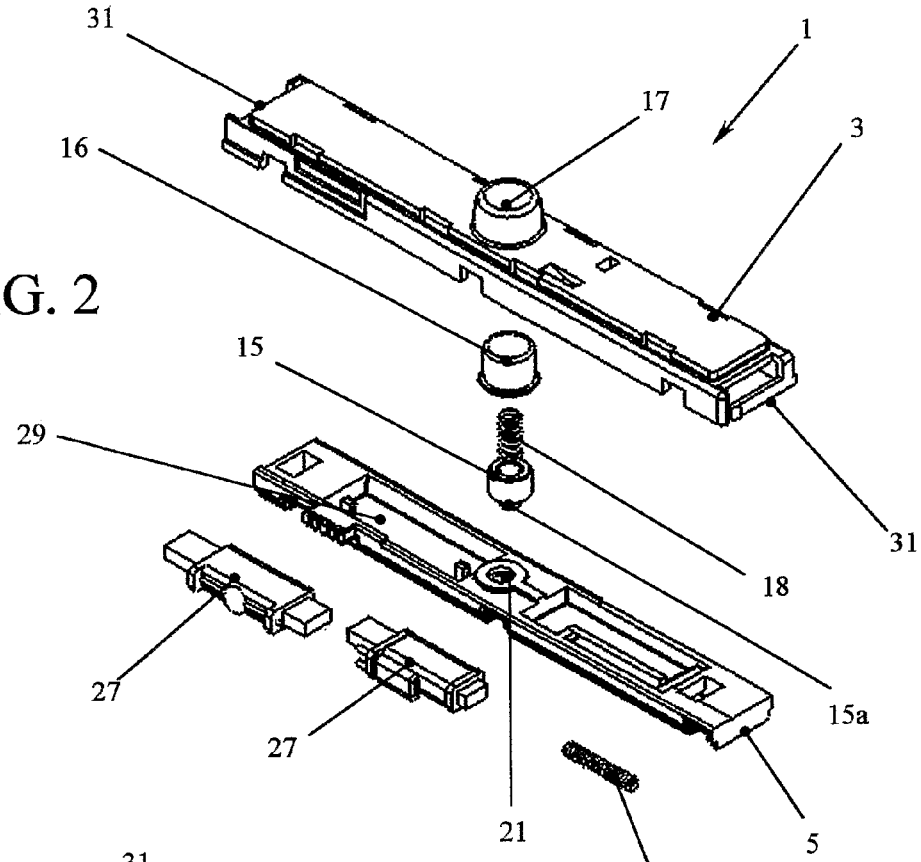
FIG. 2 shows an exploded perspective view of a preferred embodiment of the closing device according to the present invention.

FIG. 2 shows a closing device 1 according to the present invention in which the closing/opening system is composed of a locking pin 15 sliding inside a seat 17 of the external body 3 by interposing at least one coaxial spring 18 and possibly at least one fire-preventing protecting capsule 16, a lower end 15*a* of the pin 15 being adapted to engage a corresponding locking seat 19 of the locking slider 5. As known, this closing/opening system is conceived for a use with a detaching device of the magnetic type. In fact, starting for example from a closing position of the locking slider 5, in this state the locking pin 15 engages, under the thrust of the spring 18, the locking seat 19, preventing the relative sliding between slider 5 and external body 3. By using the magnetic detaching device, preferably a detaching device with an attraction force of 5000 or 9000 Gauss, the pin 15 is attracted along the seat 17 by compressing the spring 18 and disengages the locking seat 19: the slider 5 can then be made slide along the opening direction $V_A$ in order to take it to its opening position. When the attraction effect of the detaching device has ceased, the pin 15, under the elastic return thrust of the spring 18, returns against an abutment position 21 of the slider 5. When the slider 5 is made slide along its closing direction $V_C$ in order to take it to its closing position, the lower end 15*a* of the pin 15 slides on the abutment portion 21 of the slider 5 till it encounters the locking seat 19, that is again engaged under the effect of the spring 18. The closing device 1 is then again blocked in its closing position and cannot be unlocked without a new intervention of the magnetic detaching device. The sliding movement along the opening $V_A$ and closing $V_C$ directions of the slider 5 can also be aided by a sliding spring 23 coaxial with the above direction.

Figure 3:
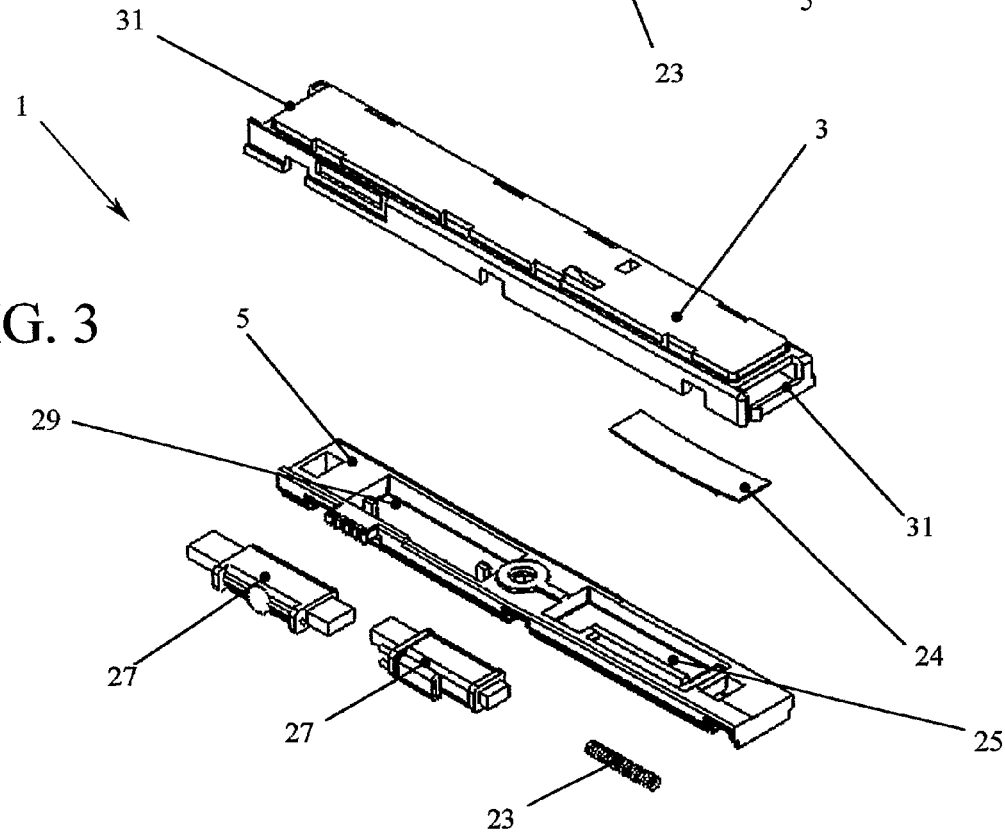
FIG. 3 shows an exploded perspective view of another preferred embodiment of the closing device according to the present invention.
Figure 4:
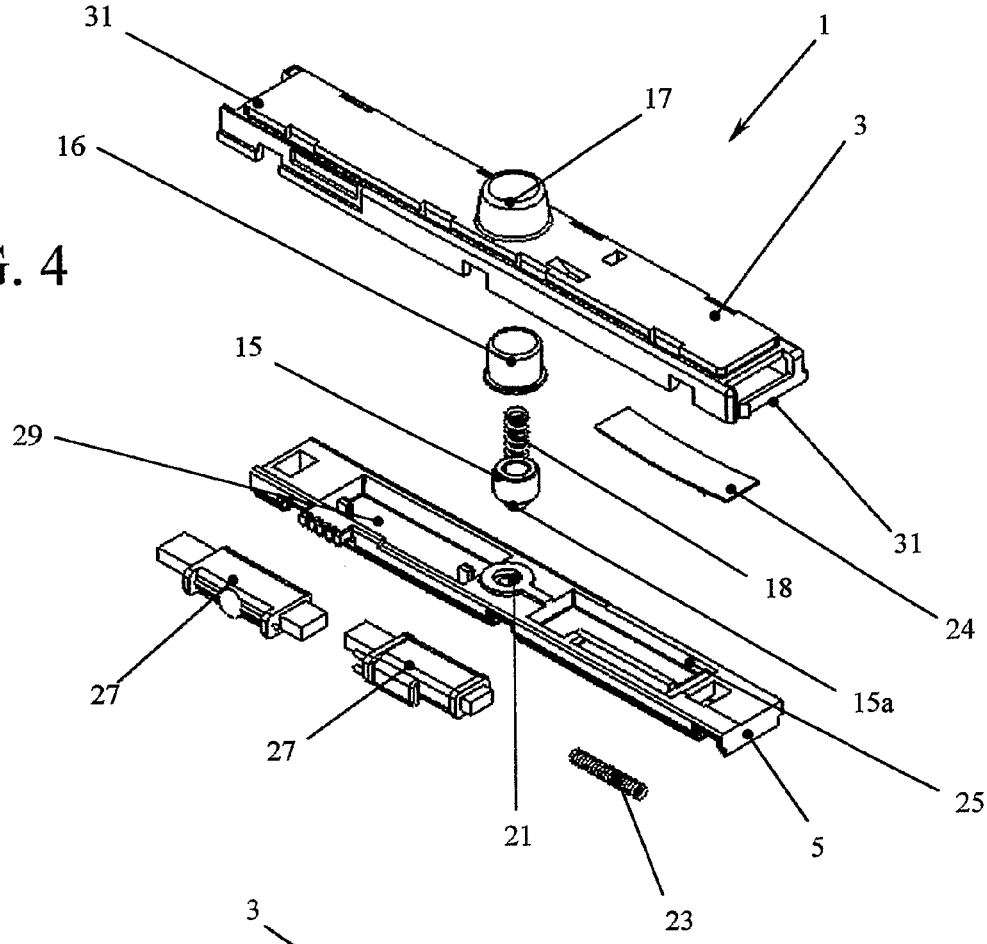
FIG. 4 shows an exploded perspective view of another preferred embodiment of the closing device according to the present invention.

FIG. 3 instead shows a closing device 1 according to the present invention in which the closing/opening system is composed of at least one reduced-encumbrance blade 24, of a known type for a magnetic detaching device preferably with 5000 Gauss, such blade 24 being contained in at least one seat 25 of the locking slider 5. In this case, it can be noted how the absence of the necessary seat for sliding the closing pin that instead can be found in the embodiment, allows obtaining a device 1 having more reduced overall sizes.

FIG. 4 instead shows a closing device 1 according to the present invention in which the closing/opening system comprises both the reduced-encumbrance blade 24 of the embodiment in FIG. 3 and the closing pin 15 of the embodiment in FIG. 2 and its related components. This particular closing/opening system can be made in order to be used only with a detaching device of the DIR5 type, mannufactured and marketed by Company NECCHI S.P.A.—Alessandria, Italy.

The safety device 1 can obviously further be equipped with any radio-frequency (RF), electromagnetic (EM) or acoustic-magnetic (AM) detecting system or adhesive label or their combinations; as an example, FIGS. 2, 3, 4 and 5 show the closing device 1 equipped with at least one detecting system of a magnetic type with ferrite core 27 contained inside a related seat 29 of the locking slider 5.

Moreover, the safety device 1 can further be equipped with at least one electronic board equipped with a sound alarm, possibly cooperating with the detecting system being present.

Obviously, the locking slider 5 can be slidingly connected to the external body 3 through any known mode, preferably through suitable engaging items whose building and arrangement are clear for any skilled person in the art.

The external body 3 further comprises the securing means to the anti-theft case 100. In particular, as can be noted for example in FIG. 5, the securing means are made as at least two engaging wings 31, preferably arranged on two opposite sides of the external body 3, equipped with securing teeth 31*a* and adapted to engage, through flexing, some complementary securing means 111 suitably built on the anti-theft case 100. In this way, should a user desire to remove the closing device 1 from the anti-theft case 100 in order to replace it with another one, it will be enough to open the case 100 itself, possibly by operating on the device 1 through the suitable detaching device or uncoupling device, and operate from inside on the two wings 31 in order to disengage them from the securing means 111 of the case 100.

The present invention further refers to an anti-theft case 100, in particular for compact-discs, musicassettes, videocassettes, DVDs, books or the like, equipped with a closing device 1 as described above.

Figure 5:
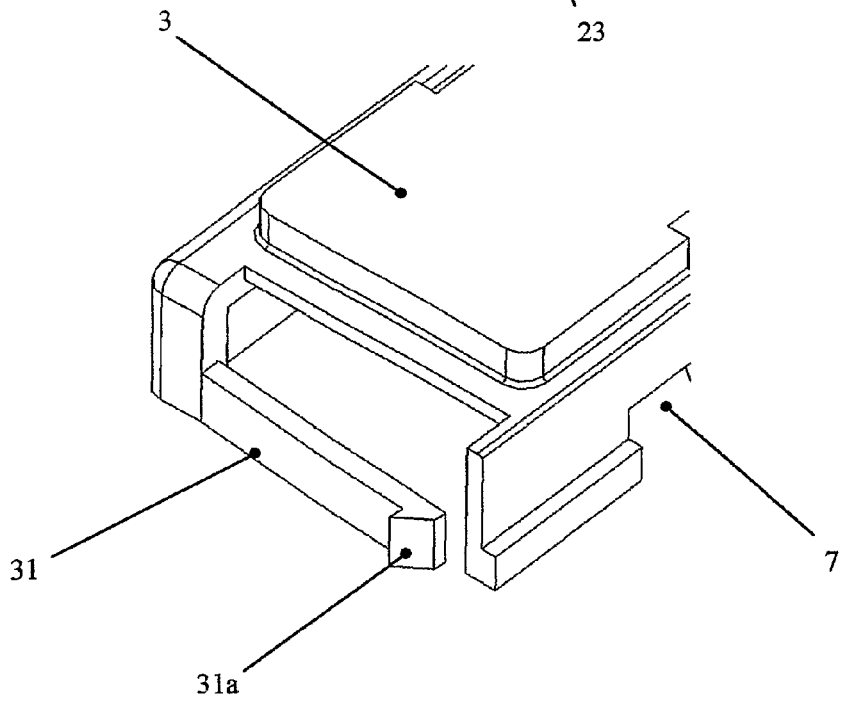
FIG. 5 shows in perspective a part of the closing device according to the present invention.
Figure 6:
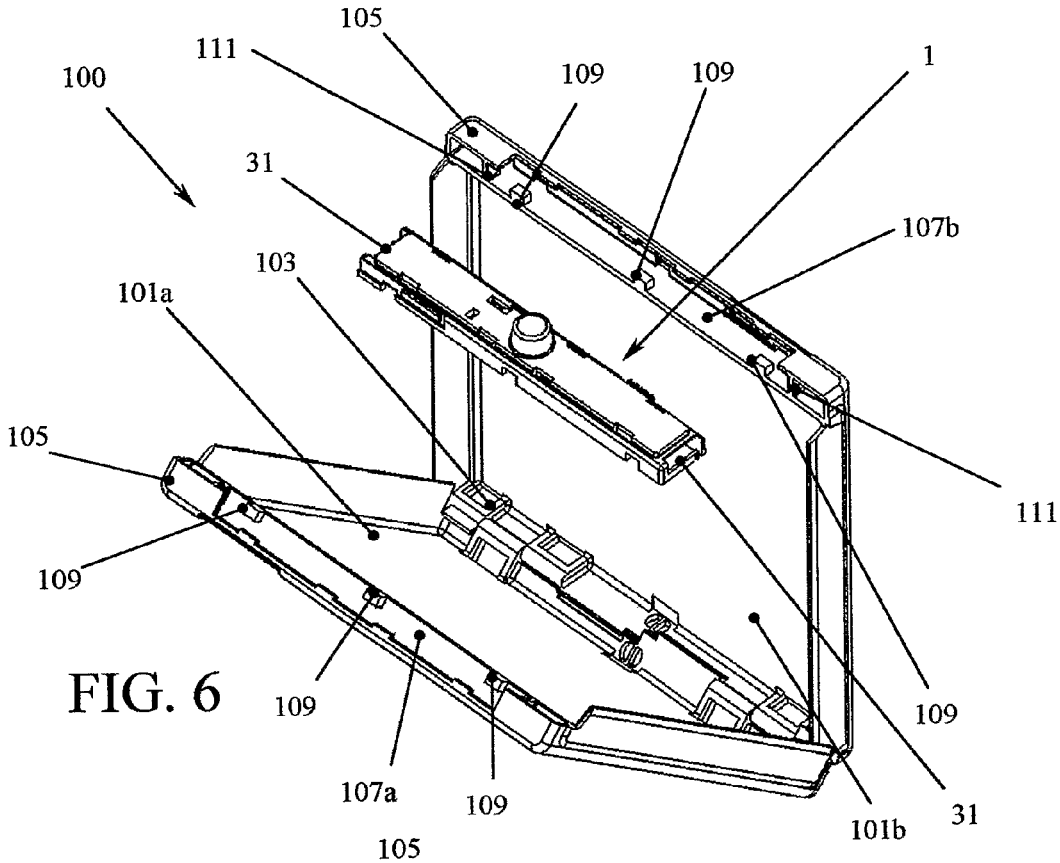
FIG. 6 shows a perspective view of a preferred embodiment of the anti-theft case according to the present invention in an operating step thereof.
Figure 7:
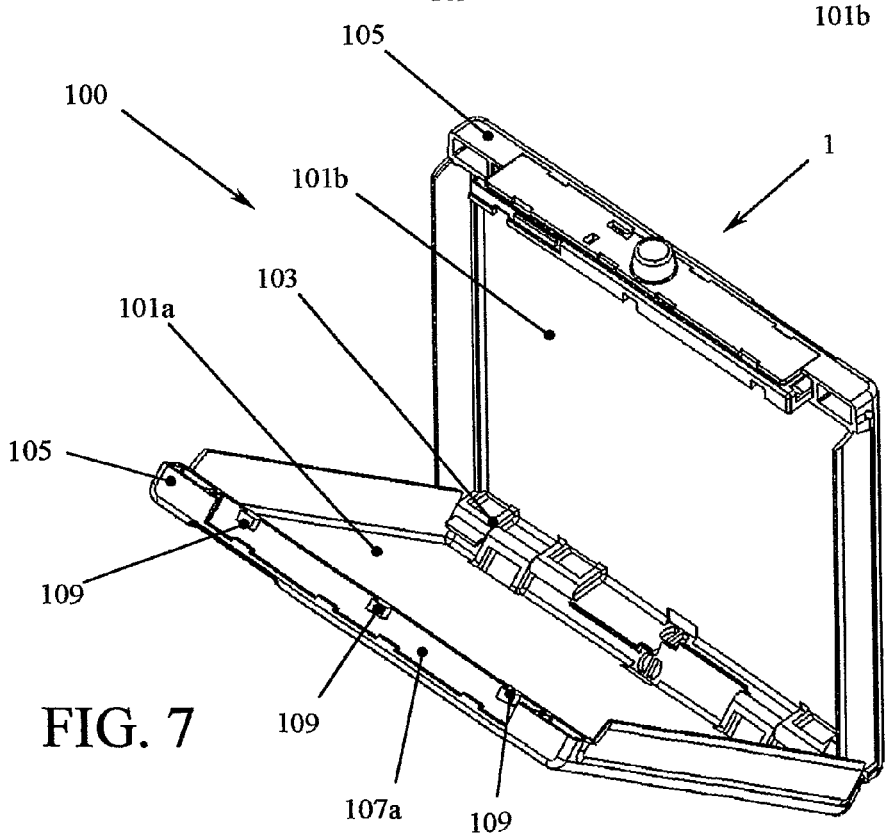
FIG. 7 shows a perspective view of the anti-theft case of FIG. 6 in another operating step thereof.

In particular, with reference to FIGS. 6 and 7, it is possible to note that the anti-theft case 100 according to the present invention is composed of two half-shells, respectively 101*a*, 101*b*, preferably mutually equal and hinged along at least one first side 103 thereof, each one of such half-shells 101*a*, 101*b* being equipped on a second side 105 thereof, preferably opposed to the first side 103, with a respective receiving seat 107*a*, 107*b* of the closing device 1, and in which at least one of such receiving seats 107*a*, 107*b* is equipped with securing means 111 complementary to the securing means of the closing device 1. At least one receiving seat 107*a*, 107*b* is further equipped with at least one locking tooth 109 arranged next to a respective slit 7 of the closing device 1 once secured to the anti-theft case 100. With particular reference to FIGS. 5 and 6, it is possible to note that, in order to secure the closing device 1 to the anti-theft case 100, one can proceed as follows:

- taking the locking slider 5 to its open position, by possibly operating with the detaching device or uncoupling device on the closing/opening system;
- inserting the closing device 1 into the receiving seat 107*a* or 107*b* by engaging the securing means 31 in the corresponding securing means 111 complementary to such receiving seat; in this step, the possible locking teeth 109 that can be found on this receiving seat are inserted through the corresponding slits 7 of the closing device 1 in order to occupy the related locking recesses 9;
- closing the half-shell of the anti-theft case 100 on the second side of which the closing device 1 is not secured, also the locking teeth 109 present on its receiving seat are inserted through the corresponding slits 7 of the closing device 1 in order to occupy the related locking recesses 9;
- taking then the slider 5 to its closing position, the locking teeth 109 remain blocked inside the respective locking recess 9 of the locking slider 5 by the closing teeth 11 that prevent them from going out, consequently preventing the anti-theft case 100 from being opened unless after the use of a suitable detaching device or uncoupling device on the closing/opening system of the closing device 1. It can also be noted that, also for removing the closing device 1, it will be necessary to take the locking slider 5 to its opening position through the detaching device or uncoupling device and to proceed in reverse with the previously described steps.

The invention claimed is:

1. A closing device for an anti-theft case having a closing/opening system adapted to be actuated by a detaching device or uncoupling device, the closing device comprising:

securing means for securing the closing device to the anti-theft case so that the closing device is adapted to be applied to or removed from the anti-theft case only when the anti-theft case is open;

an external body;

a locking slider inside the external body, the locking slider longitudinally sliding along a closing direction and an opening direction in order to go to a closing position and an opening position;

at least one closing tooth integral with the locking slider;

at least one locking recess inside the external body;

at least one first slit on the perimeter of the external body; and a second slit on the external body, wherein the first slit is adapted to allow access from outside the external body to the at least one locking recess inside the external body, the recess being defined by the at least one closing tooth integral with the locking slider and corresponding to the second slit, so that when the locking slider is in the closing position, the closing tooth is placed between the locking recess and the second slit, and when the locking slider is in the opening position, the closing tooth frees a passage between the locking recess and the second slit.

2. The closing device of claim 1, wherein the anti-theft case comprises two half-shells that are mutually hinged along at least one side of the half-shells.

3. The closing device of claim 2, wherein the two half-shells of the anti-theft case are mutually equal.

4. The closing device of claim 1, further comprising one or more detecting systems or adhesive labels.

5. The closing device of claim 4, wherein the locking slider has at least one tongue going out of a guiding slot of the external body.

6. The closing device of claim 1, wherein the closing/opening system comprises a locking pin that slides inside a seat of the external body by interposing at least one coaxial spring, a lower end of the pin being adapted to engage a corresponding locking seat of the locking slider.

7. The closing device of claim 6, wherein the locking pin comprises at least one fire-prevention capsule.

8. The closing device of claim 1, wherein the closing/opening system comprises at least one blade having a reduced encumbrance contained in at least one seat of the locking slider.

9. The closing device of claim 8, wherein the closing/opening system further comprises the locking pin.

10. The closing device of claim 1, wherein the detaching device is a magnetic detaching device.

11. The closing device of claim 10, wherein the detaching device has an attraction force of between 5000 and 9000 Gauss.

12. The closing device of claim 1, wherein the detecting system comprises at least one ferrite core contained inside a seat of the locking slider.

13. The closing device of claim 1, wherein the closing device comprises at least one electronic board having a sound alarm, the electronic board cooperating with the detecting system.

14. The closing device of claim 1, wherein the securing means comprise at least two engaging wings of the external body, the engaging wings having securing teeth and being adapted to engage by flexing complementary securing means of the anti-theft case.

15. An anti-theft case for protecting at least one of compact-discs, audio cassettes, videocassettes, DVDs, and books, the anti-theft case comprising:

a closing device having a closing/opening system; and two half-shells mutually hinged along at least one first side of the half-shells, each of the half-shells having a second side opposite to the first side with a receiving seat for receiving the closing device, wherein the closing device includes:

securing means for securing the closing device to the anti-theft case so that the closing device is adapted to be applied to or removed from the anti-theft case only when the anti-theft case is open;

an external body;

a locking slider inside the external body, the locking slider longitudinally sliding along a closing direction and an opening direction in order to go to a closing position and an opening position;

at least one closing tooth integral with the locking slider;

at least one locking recess inside the external body;

at least one first slit on the perimeter of the external body; and a second slit on the external body, wherein the first slit is adapted to allow access from outside the external body to the at least one locking recess inside the external body, the recess being defined by the at least one closing tooth integral with the locking slider and corresponding to the second slit, so that when the locking slider is in the closing position, the closing tooth is placed between the locking recess and the second slit, and when the locking slider is in the opening position, the closing tooth frees a passage between the locking recess and the second slit, and at least one of the receiving seats comprises securing means complementary with the securing means of the closing device.

16. The anti-theft case of claim 15, wherein at least one of the receiving seats comprises at least one locking tooth arranged next to a slit of the closing device.

17. The anti-theft case of claim 16, wherein the locking tooth is adapted to be inserted through one of the slits of the closing device in order to occupy one of the locking recesses of the locking slider.

18. The anti-theft case of claim 17, wherein when the slider is in the closing position, the locking tooth is adapted to be blocked inside the locking recess of the locking slider by the closing teeth so as to prevent opening of the anti-theft case.

* * * * *